United States Patent [19]

Iwasaka et al.

[11] 4,064,971

[45] Dec. 27, 1977

[54] ELEVATOR SERVICE INFORMATION APPARATUS

[75] Inventors: Tatsuo Iwasaka; Takashi Kaneko, both of Katsuta; Seiichi Shimazaki, Kamagaya, all of Japan

[73] Assignee: Hitachi, Ltd., Japan

[21] Appl. No.: 682,343

[22] Filed: May 3, 1976

[30] Foreign Application Priority Data

May 12, 1975 Japan ..... 50-54538

[51] Int. Cl.[2] ..... B66B 3/00

[52] U.S. Cl. ..... 187/29 R

[58] Field of Search ..... 187/29

[56] References Cited

U.S. PATENT DOCUMENTS

| | | | |
|---|---|---|---|
| 2,100,736 | 11/1937 | Eames | 187/29 |
| 3,511,342 | 5/1970 | Hall et al. | 187/29 |
| 3,844,383 | 10/1974 | Iwasaka et al. | 187/29 |
| 3,902,571 | 9/1975 | Iwasaka et al. | 187/29 |

*Primary Examiner*—Robert K. Schaefer
*Assistant Examiner*—W. E. Duncanson, Jr.
*Attorney, Agent, or Firm*—Craig & Antonelli

[57] ABSTRACT

In an elevator system including a plurality of elevator cars adapted to serve a plurality of floors, an elevator service information apparatus which predicts the arrival order of the elevator cars arriving at a predetermined floor to give car awaiting passengers information about the arrival order. The arrival prediction may be made for the cars which will arrive at the predetermined floor in a predetermined range of the arrival sequence.

9 Claims, 14 Drawing Figures

| FLOOR / CARS | A | B | C | D | E | F |
|---|---|---|---|---|---|---|
| ARRIVAL ORDER | 3 | 6 | 5 | 4 | 1 | 2 |

ELEVATOR SERVICE INFORMATION APPARATUS

The present invention relates to a service information apparatus for an elevator system. In particular, the invention concerns with the elevator service information apparatus suitable for relieving a crowd of increased number of elevator car awaiting passengers at an elevator hall.

In the elevator system installed in an office building, for example, it is known that the traffice demand from the ground or lobby floor is remarkably increased at the time to attend office. Under the circumstances, it is usually impossible to instantaneously provide the demanded service to all the passengers, since the number of the installed elevator cars is often restricted. As a consequence, the elevator hall will be overcrowded with the increasing number of passengers, resulting in a serious confusion.

When a plurality of elevator cars are built in juxtaposition, it is difficult for the passengers standing in the vicinity of the doors of the elevator cars to know which car will arrive at first. For this reason, the passengers, tend to await the car at a place somewhat remoted from the cars such as the entrance of the elevator hall where the passengers can have a whole view of the elevator cars. Under such situations, the entrance region of the elevator hall will be crowded with the passengers in a moment with a result that even the lobby region will become confused with the overflowing passengers. Although some of the passengers standing at the front of the crowd can get information of the condition of the elevator car service, those persons who are awaiting at the rear of the crowd may not have the chance to see how the elevator cars are going about. When a car has arrived, the passengers will rush in it striving to be the foremost, and thus the confusion becomes more serious.

Heretofore, it has been known to display at an early time an elevator car which is destined to perform the service for a produced hall call. In this case, the produced hall call is allotted to a suitable car and the service of the car for the hall call is displayed at the calling hall or floor. The passenger awaiting at the hall can get information of only one car, which will first arrive at the floor, and await in front of the door of the coming car. However, the number of the passengers allowed to be carried by a single car is restricted. Accordingly, a confusion at the entrance region of the elevator hall is not avoidable at the crowding time such as at the time to attend office.

An object of the invention is to provide an elevator service information apparatus which can relieve a crowd of elevator car awaiting passengers at an elevator hall and enhance the service of the elevator cars for the passengers.

According to a feature of the invention, there is provided an apparatus for predicting the order or sequence in which a plurality of elevator cars installed in juxtaposition arrive at a predetermined floor and giving information about the predicted arrival order to the passenger awaiting the cars at the elevator hall.

According to another aspect of the invention, the arrival order prediction is made only for the cars in predetermined positions or in predetermined states, thereby to avoid an extravagant prediction and display which may eventually incur a confusion in a crowd of the passenger. The elevator service information apparatus according to the invention can be manufactured inexpensively with a simple construction.

Above and other objects, features and advantages of the invention will become more apparent from the description of preferred embodiments taken in conjunction with the accompanying drawings, in which.

In the first place, a general arrangement of an elevator service system according to the invention will be described with reference to FIGS. 1 to 6..

Figure 1:
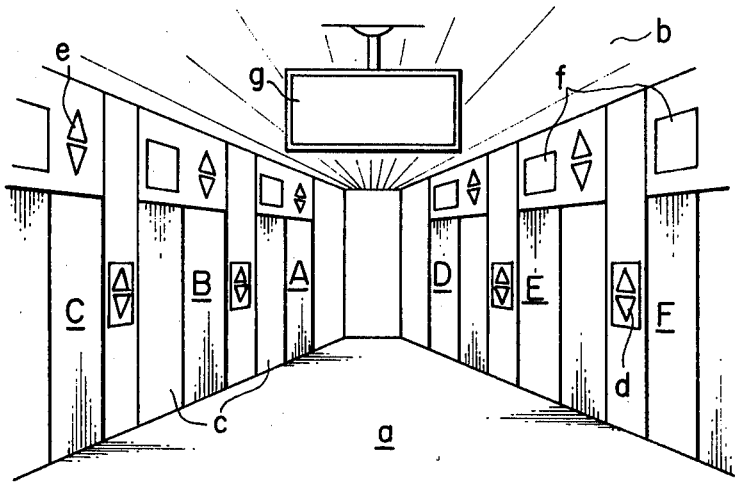
FIG. 1 is a perspective view showing an elevator hall to which the invention is applied.

FIG. 1 is a perspective view showing an elevator hall provided with six elevators A to F installed in juxtaposition. Reference symbols *a* and *b* denote, respectively, a floor and a ceiling of the elevator hall. Symbol *c* indicates doors of the elevators. For registration of the hall calls, call buttons *d* are provided for the associated elevators. Symbol *e* designates hall lanterns. Display devices *f* and *g* are provided according to the invention in order to indicate the order in which the elevator cars will come to the hall. Passengers waiting for the services of the elevator cars at the hall are thus informed of the order or sequence in which the elevator cars will arrive at the elevator hall. Examples of such arrival order display devices are shown in FIGS. 2 and 3.

Figure 2A:
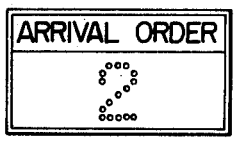
FIGS. 2A and 2B show exemplary embodiments of an arrival order display device according to the invention.
Figure 2B:
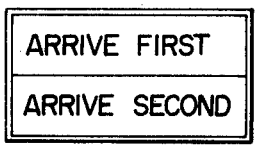
Figure 3:
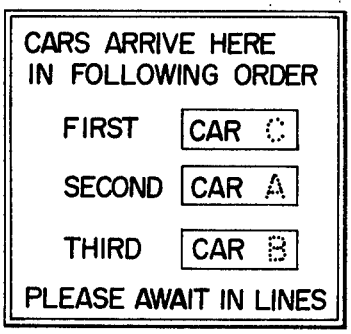
FIG. 3 shows another exemplary embodiment of the arrival order display device according to the invention.

FIGS. 2A and 2B illustrate exemplary configurations of a display device which may correspond to the arrival order display device *f* shown in FIG. 1. These display devices are adapted to be installed in the vicinity of the entrances of the associated elevators to give information of the arrivals of the associated cars, respectively. An example of the display device *g* shown in FIG. 1 is illustrated in FIG. 3, The display device *g* of this type is preferably disposed at the entrance of the elevator hall and destined to generally inform the arrival order or sequence of plural elevator cars. In the case of the illustrated embodiment, the display device *g* is adapted to indicate the first to third elevator cars of six cars, which are coming to the hall in this sequence. In practice, services by three elevator cars will be sufficient for relieving a usual crowd of car awaiting passengers. Of course, it is possible to constract the display device *g* so that it may produce arrival information of the first and the second or the first to the fourth serviceable cars, as occasions require.

Figure 4:
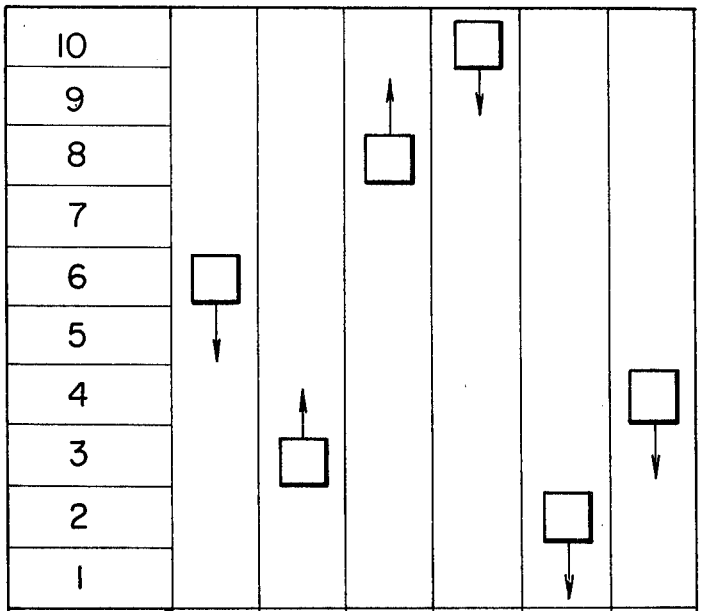
FIG. 4 shows schematically running conditions of elevator cars for explaining the invention.

In more particular, it is assumed that six elevator cars A to F are arranged to serve the first to tenth floors of a building and are now located in such positions as shown in FIG. 4, and that a display of car arrival order is made on the first floor. Arrows attached to the individual cars indicate the directions in which the respective cars are to be driven. Under these circumstances, when a prediction is made about the order in which the elevator cars reach the first floor on the basis of the instantaneous locations of the cars, the prediction will show that the arrival order of the cars is the order of E, F, A, D, C, and then B. The thus predicted arrival order of the elevator cars is informed to the car awaiting passengers by means of the display devices *f* and *g* installed at the elevator hall on the first floor.

Both the display devices *f* and *g* may be installed at the elevator hall so that information of the elevator car arrival may be assured and easily recognized. However, it should be appreciated that the provision of either the display *f* or *g* in accordance with the condition of the elevator hall will be sufficient for the contemplated purpose. For example, in the case where no special elevator hall is provided and a lobby or passage serves also for the elevator hall, a single display device of such a type as shown in FIG. 2 will be advantageously employed. On the other hand, when an elevator hall is independently provided together with an exclusive entrance therefor, a display device of such a type as shown in FIG. 3 is preferred to generally give information of the car arrival order at the entrance.

The visual type display devices are employed in the illustrated embodiment. However, another type of information device such as an audio or sound device may be employed to give similar information of car arrival order to the awaiting passengers. In general, a device for informing the awaiting passengers of the arrival order of the serviceable elevator cars may be referred to as an arrival order informing device.

Figure 5:
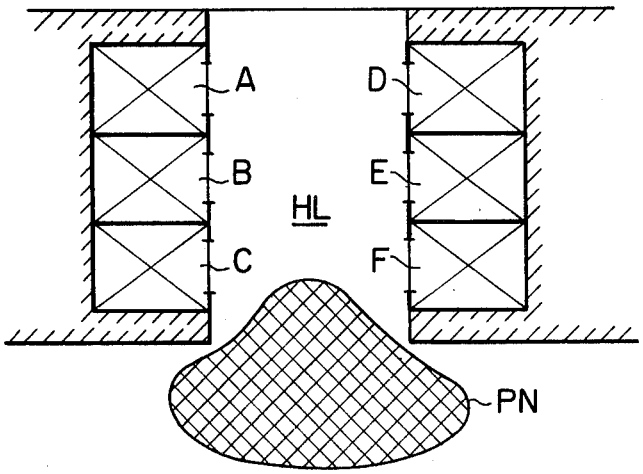
FIG. 5 PRIOR ART
FIG. 5 illustrates behaviours of car awaiting passengers in the case of a hitherto known elevator system.

By giving information such as above on the arrival order of serviceable elevator cars to the passengers awaiting at the hall, an advantageous elevator service can be conducted without incurring any confusion even when the number of the awaiting passengers is very increased as at the time to attend office. For example, reference should be made to FIG. 5 showing illustratively behaviors of passengers which tend to be taken when information on the car arrival order is not given. FIG. 5 is a schematic plan view of the elevator hall shown in FIG. 1 wherein reference symbols A to F indicate elevator shafts. As will be seen from the figure, the passengers who have no information about the arrival order of the elevator cars will be likely to stand at the entrance of the elevator hall HL without entering the hall for the reasons as described hereinbefore. Thus, the entrance of the hall HL is crowded with the passengers overflowing to the exterior as indicated by a hatched region PN.

Figure 6:
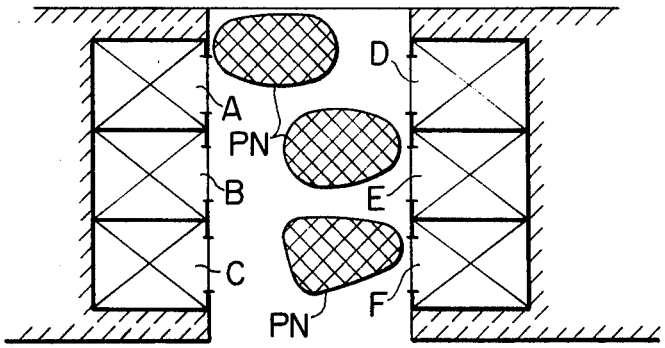
FIG. 6 illustrates behaviours of car awaiting passengers in the case of employing the elevator service information apparatus according to the invention.

In contrast, FIG. 6 shows illustratively in a similar view to FIG. 5 how the passengers will behave at the elevator hall when they are in the position to have information about the arrival order of the serviceable elevator cars. The passengers will form regular arrays or groups in front of the elevator cars in accordance with the informed arrival order without involving a confusion or overflowing, as indicated by hatched areas PN in FIG. 6. For example, a person who comes first to the elevator hall will place himself in front of an elevator car for which information is made such that it arrives first. When the number of passengers awaiting the first coming elevator car becomes increased, persons coming later to the hall will make another regular group in front of another elevator car for which information is made such that it arrives second, and so forth. In this manner, passengers who have information about the arrival order of the elevator cars through the apparatus according to the invention will make successively regular groups before the elevator cars in accordance with the informed arrival order of the cars. Accordingly, there will not occur such situation that all the passengers awaiting at the entrance region of the elevator hall will rush in a just arrived elevator car as is the case wherein no arrival information is vailable. Furthermore, when the arrival order information apparatus according to the invention is provided, persons who are in haste can follow the passenger row awaiting the first coming elevator car even if it would become relatively crowded. On the other hand, such persons as carrying luggages can select a less crowded elevator car even thought it comes later.

In this way, by providing the arrival order information apparatus according to the invention, the crowd of passengers awaiting at the elevator hall can be relieved and enhanced service of the elevator systems for the passengers can be assured.

Now an embodiment of the apparatus for predicting and informing the arrival order of elevator cars will be described in detail by referring to FIGS. 7 to 8. In the following description, it is assumed that three cars A, B and C perform services for the first to tenth floors, inclusive, and prediction and information are made on the order in which these cars arrive at the first floor.

Figure 7:
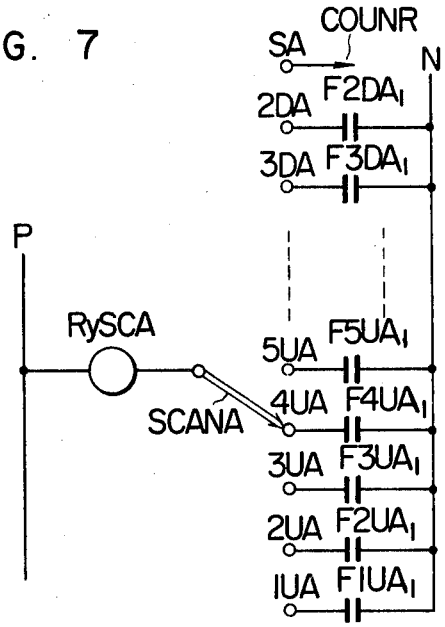
FIG. 7 is a schematic circuit diagram showing a car position searching circuit which is necessarily provided for each elevator car.

FIG. 7 shows a position searching or scanning circuit for the elevator car A with some circuitries of the same construction omitted as indicated by broken lines. Similar position searching circuits are necessarily provided for cars B and C. Two sets of contact terminals 1UA to 9UA and 2DA to 10DA are provided for the first to tenth floors in association with the upward and downward directions of the elevator cars. These contact terminals 1UA to 9UA and 2DA to 10DA are connected to the bus bar N of a power source through contacts $F1UA_1$ to $F9UA_1$ and $F10DA_1$ to $F2DA_1$ of position detecting relays of the elevator car A. The position detecting relays are not illustrated in the figures, but these relays are well-known relays provided for respective floors and moving directions of the car for detecting the position of the car including its moving direction. Thus, it should be noted hereinafter that the "position of the car" means not only a position at which the car exists but also a direction in which the car moves at the position. For example, the contact $F1UA_1$ is a normally open contact which is closed when the car A is in the position to move upwardly from the first floor. A scanning switch SCANA is made to cyclically scan the contact terminals 1UA to 9UA and 10DA to 2DA and a contact SA with a predetermined time interval to search the positions of the car A. For example, when the car A is positioned at the first floor in the upward direction, a closed circuit path is formed from a positive bus bar P of the power source through a searching relay RySCA, the scanning switch SCANA, the contact terminal 1UA and the relay contact $F1UA_1$ to the negative bus bar N, whereby the searching relay RySCA is energized. It is to be noted that the contacts 1UA to 9UA and 10DA to 2DA and SA are arranged in a ring-like configuration, and the searching relay RySCA is energized when the car A is positioned at the floor and in the direction corresponding to the contact terminal just contacted by the scanning switch SCANA during the cyclical scanning operation thereof. In this circuit, it should be noted that the scanning switch SCANA is driven circulatively in the direction starting from the contact terminal SA, through the terminals 2DA, 3DA, . . . , 2UA and 1UA and then back to the terminal SA. The contact terminal SA is used to derive a reset signal COUNR for a counter described hereinafter.

Scanning switches SCANB and SCANC (not shown) of the similar position searching circuits provided for the elevator cars B and C are driver in synchronism with the scanning switch SCANA. Contact terminals SB and SC (not shown) are provided in the position searching circuits for cars B and C, which however must not be used for deriving a reset signal as in the terminal SA.

Figure 8:
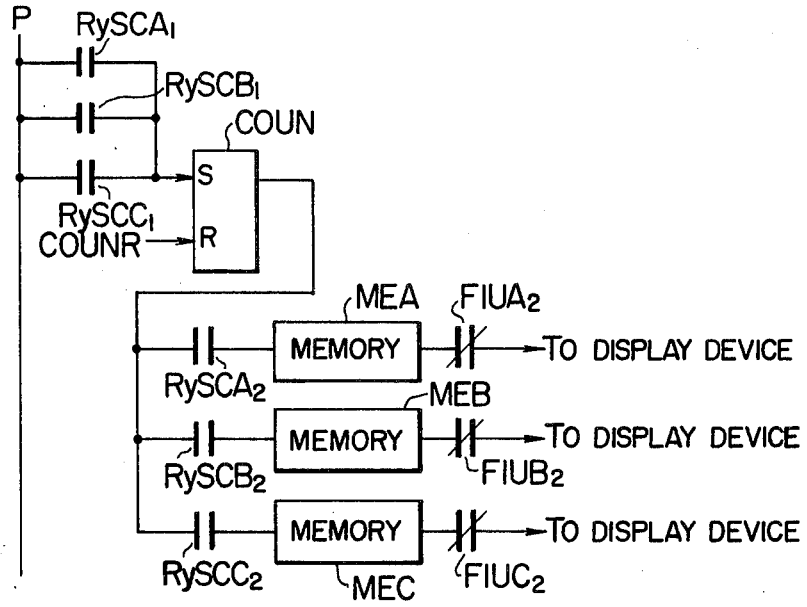
FIG. 8 is a schematic circuit diagram showing an arrival order estimating circuit used in association with the car position searching circuit of FIG. 7.

FIG. 8 shows a circuit for estimating the arrival order of the elevator cars in accordance with relay signals derived from the position searching circuits for cars A, B and C.

In FIG. 8 reference symbol COUN denotes a counter having a reset terminal R. The contents of the counter COUN is stored by memories MEA, MEB and MEC provided for the respective elevator cars A, B and C. Contacts $RySCA_1$ and $RySCA_2$, $RySCB_1$ and $RySCB_2$, and $RySCC_1$ $RySCC_2$ are normally open contacts which are closed when the searching relay RySCA, RySCB (not shown), and RySCC (not shown) are energized, respectively.

Referring again to FIG. 7, when the scanning switch SCANA makes contact with the contact terminal SA, a closed circuit of P - Ry SCA - SCANA - SA is completed, whereby the reset signal COUNR is fed to the reset terminal R of the counter COUN shown in FIG. 8 to rest the content thereof to zero.

Now, it is assumed that the elevator car A is moving downwardly from the second floor, while the car B is moving downwardly from the third floor. When the scanning switch SCANA shown in FIG. 7 contacts with the contact terminal 2DA subsequent to contacting with the contact terminal SA, the searching relay RySCA is energized since the elevator car A exists at the second floor in the downward direction and thus the contact $F2DA_1$ is closed.

When the searching relay RySCA is energized, an input signal is applied to the set terminal S of the counter COUN through the contact $RySCA_1$. Consequently, the content of the counter COUN is changed from zero to 1. Simultaneously, the contact $RySCA_2$ is closed and the content of the counter COUN is transferred to the memory unit MEA. The memory MEA now storing count "1" transmits its content as an output to an arrival order informing device such as shown in FIG. 2 or 3 through a contact $F1UA_2$, thereby informing that the car A will arrive first.

On the other hand, when the scanning switch SCANA of FIG. 7 subsequently makes contact with the contact terminal 3DA, the position searching relay RySCA is deenergized because the car A does not exist at the third floor and the contact $F3DA_1$ is opened. However, the searching relay RySCB (not shown) of the position searching circuit for the car B is energized because the car B is moving at the third floor downwardly. Therefore, the contact $RySCB_1$ is closed, so that the counter COUN changes its content from "1" to "2". At the same time, the contact $RySCB_2$ is closed so that the content of the counter COUN is transferred to the memory MEB for the car B. The count "2" thus stored in the memory MEB is fed through a contact $F1UB_2$ to an arrival order informing device such as shown in FIG. 2 or 3 for informing that the car B will arrive second.

The contacts $F1UA_2$, $F1UB_2$ and $F1UC_2$ are provided for inhibiting displays of arrival orders of the cars A, B and C, respectively, when the cars exist at the first floor. These contacts are constituted by normally closed contacts of the position detecting relays for detecting the elevator cars A, B and C positioned at the first floor in the upward direction. When one of the elevator cars stops at the first floor, it is meaningless to display the arrival order with respect to that car. Therefore, the contacts $F1UA_2$, $F1UB_2$, $F1UC_2$ act for producing information about the arrival order of the other elevator cars. In this manner, the passenger awaiting the elevator cars at the first floor can have information about the predicted arrival order of the elevator cars.

In the above described embodiment, it is noted that the prediction of the arrival order is effected by utilizing the position signals of the respective cars and on the basis of the locational relationships among them. The apparatus for implementing this principle can be advantageously constructed in a very inexpensive and much simplified structure.

In the case of the aforementioned embodiment, the display apparatus is adapted to display or inform of the arrival order for all the elevator cars. However, it is rather preferred to inhibit informing of the arrival order for elevator cars such as have just left the first floor, which require a lot of time for coming again to the first floor. For example, when it takes a long time for the elevator car to reach a calling floor, there will arise a probability that the arrival order may be changed in the meantime, which would incur a degradation in the reliability of the arrival order information. Further, informing of the arrival order of an elevator car with no service of the car for a long time will possibly make the awaiting passengers uncomfortable. Also, in case a number of elevator cars are installed in juxtaposition, informing of the arrival order for all the elevator cars will be useless.

Figure 9:
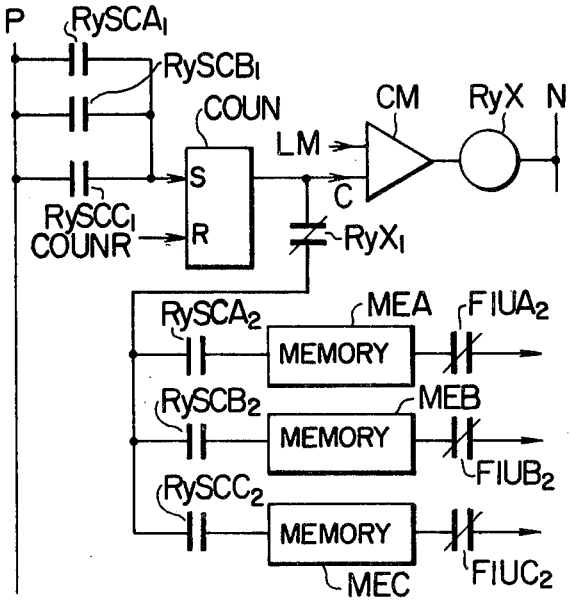
FIG. 9 shows a modification of the circuit shown in FIG. 8.

FIG. 9 shows an embodiment of the invention in which arrival order display or information is made to only two elevator cars earlier in the arrival order. The circuit of FIG. 9 is employed in place of that shown in FIG. 8, and the circuit elements common to those of the circuit of FIG. 8 are denoted by the same reference symbols. It is assumed that the circuit shown in FIG. 9 is used in combination with the circuit shown in FIG. 7 without modifications thereto.

Assuming now that the output C of the counter COUN corresponds to the count "2" under the conditions described hereinbefore, the output signal C is compared with a limit signal LM of a level corresponding to the count "2" by a comparator CM which is adapted to produce an output of logic "1" when the condition C ≦ LM is fulfilled. Then, a delay relay RyX will be actuated in response to the output logic "1" from the comparator CM, whereby the normally closed contact $RyX_1$ of the relay RyX is opened. The actuation of the delay relay RyX is delayed relative to the relays RySCA, RySCB and RySCC so that, when the output of count "1" appears at the output terminal of the counter COUN, the contact $RyX_1$ of the delay relay RyX is opened after the counter output has been stored in the memory MEA, MEB, or MEC. Thus, any display or information is not made with respect to an elevator car of the third and later arrival order.

Figure 10:
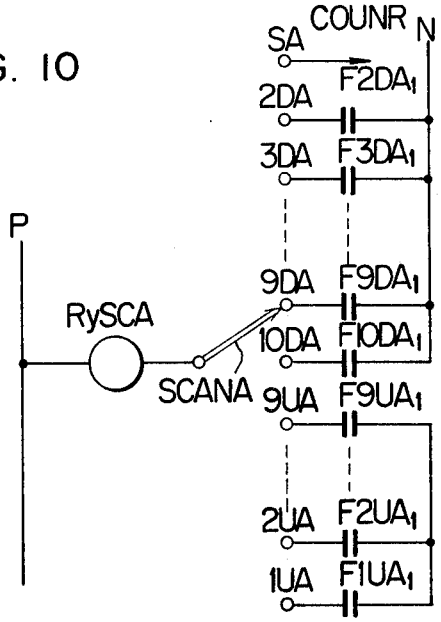
FIG. 10 shows a modification of the circuit shown in FIG. 7.

FIG. 10 shows another embodiment of the invention in which elevator cars the arrival order of which is to be displayed are restricted to those moving downwardly. This circuit of FIG. 10 is employed in place of the circuit shown in FIG. 7 with the circuits of FIG. 8 used together without any modifications. It can be seen that the bus bar N of the power source is connected only to the relay contacts $F2DA_1$ to $F10DA_1$ for detecting the position of the elevator car A moving downwardly. On the contrary, the relay contacts $F9UA_1$ to $F1UA_1$ for responding to the upwardly moving car A are not connected to the bus bar N. With such circuit arrangement, the relay RySCA is actuated in dependence upon the scanning position of the scanning switch SCANA only when the car A is moving downwardly, thereby to close the relay contacts $RySCA_1$ and $RyCSA_2$ shown in FIG. 8, thereby displaying the arrival order with respect to the car A in the manner described hereinbefore. On the other hand, when the car A is in the upward direction, the relay RySCA will never be energized regardless of any positions taken by the scanning switch SCANA. Of course, similar circuits as the circuit of FIG. 10 are provided for the cars B and C, and the same operation as above is effected. In this manner, the display of the arrival order is limited to the downwardly moving elevator cars.

According to the just described embodiment, the circuit construction can be simplified. Although the circuit diagram of FIG. 10 is shown somewhat complicated due to the unnecessary circuit components being retained for the convenience' sake of description. In practice, the relay contacts $F1UA_1$ to $F9UA_1$ for detecting the upward car positions as well as the associated contact terminals 1UA to 9UA may be omitted, and the scanning switch SCANA can be realized in a small size.

In the described embodiment shown in FIG. 10, elevator cars the arrival order of which is to be displayed is restricted to those moving downwardly. However, it will be appreciated that the same principle can be applied to the case in which the arrival order display is to be made only for elevator cars located within a predetermined range of car position. For example, if the relay contacts $F1UA_1$ to $F9UA_1$ and $F10DA_2$ to $F6DA_2$ are removed from the circuit shown in FIG. 10, the prediction of the arrival order is made only for elevator cars positioned below the fifth floor in the downward direction.

In the above described embodiments, it is assumed that prediction and information are made with respect to the arrival order of elevator cars arriving at the first floor. It will be appreciated, however, that such a prediction and information can be effected with respect to elevator cars arriving at another floor by a similar circuit arrangement. In this connection, an explanation will be made of the case where the arrival order of elevator cars arriving at the third floor in the upward direction. In this case, the contact terminal SA for deriving the reset signal COUNR, shown in FIG. 7, is disposed between the contact terminals 3UA and 2UA. The scanning switch SCANA is driven, similarly to the above, in the direction starting from the contact terminal SA, through the terminals 2UA, 1UA, 2DA, . . . , 3UA and then back to the terminal SA. The contact terminal 3UA is scanned last. This is because an elevator car arriving and staying at the third floor is not necessary to be predicted in its arrival order and an elevator car which has just started from the third floor in the upward direction will serve the third floor in the upward direction latest. The contact terminal 3UA is not necessarily provided so that an elevator car arriving at the third floor may be omitted from the arrival order prediction. In the case under consideration, it is necessary to replace the contacts $F1UA_2$, $F1UB_2$ and $F1UC_2$ by normally closed contacts $F3UA_2$, $F3UB_2$ and $F3UC_2$ (not shown) of the position detecting relays for detecting cars A, B and C positioned at the third floor in the upward direction.

In the case of the embodiments described in the foregoing, prediction of the arrival order is effected on the basis of the spatial or positional relationships among the elevator cars. It has, however, been found that the number of floors at which the elevator cars are to be stopped before the arrival at a particular floor should be taken into consideration when the accuracy of the arrival order prediction is to be more increased. In other words, the arrival order should be determined on the basis of a period of time required for the elevator car to reach the particular floor, which period of time is determined in consideration of the number of floors to be passed by the elevator car before the arrival at the floor as well as the number of floors at which the elevator car is stopped in the course. In this connection, floors at which the car is stopped (hereinafter referred to simply as landing floors) is those for which the cage calls are produced in the car. Further, in the case of the elevator system in which means are provided to allot produced hall calls to elevator cars, floors which are associated with the allotted hall calls are involved in the landing floors.

In the following an arrival order information apparatus emboding the aforementioned principle will be described. It is again assumed for the convenience' sake of description that display or information of the arrival order is made at the first floor and three elevator cars A, B and C are installed in juxtaposition as in the case of the preceding embodiments.

Figure 11:
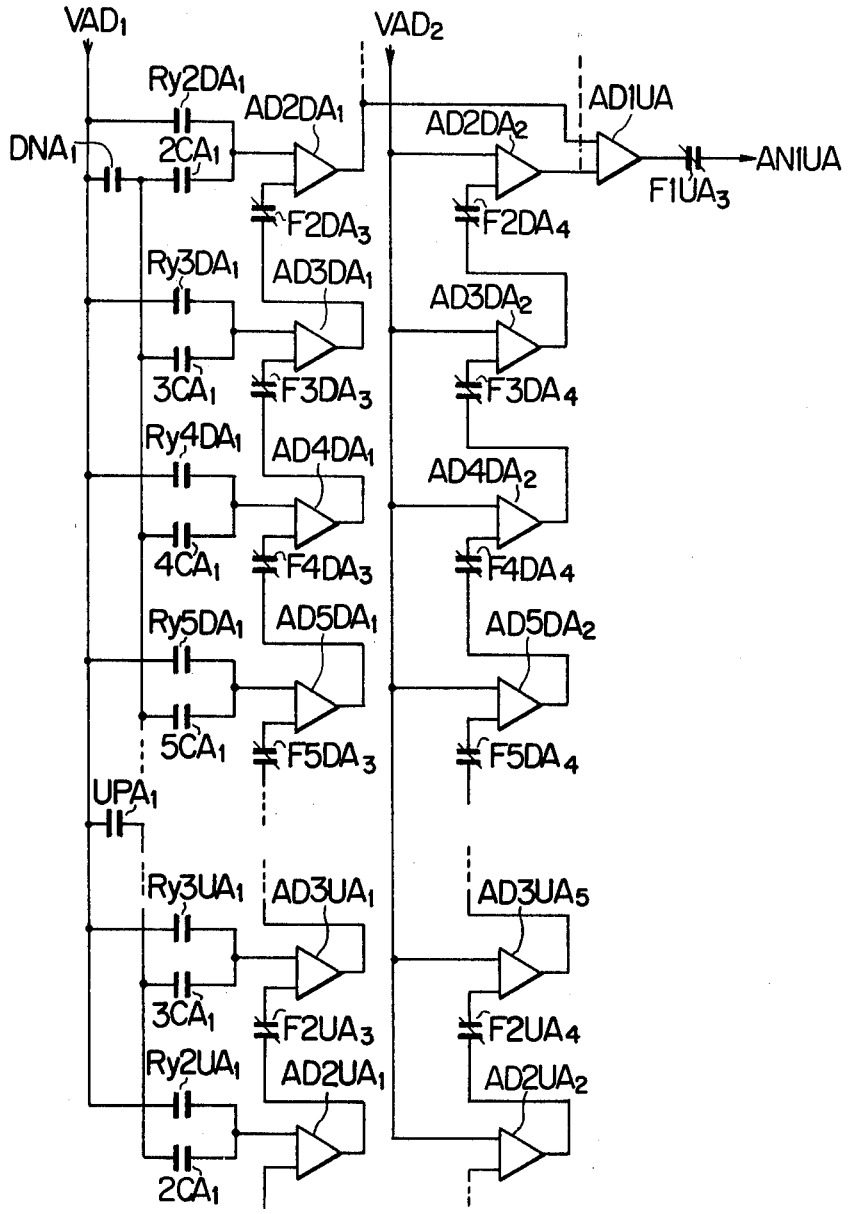
FIG. 11 is a schematic circuit diagram showing a circuit for calculating a predicted time required for car arrival, which is necessarily provided for each elevator car.

FIG. 11 shows a circuit for calculating a period of time required for the elevator car A to arrive at the first floor. This circuit is provided for each of the cars A, B and C. It is noted that some circuitries of the same construction are omitted from the drawing as indicated by dotted lines.

In FIG. 11, reference symbol VAD1 represents a set voltage corresponding to a time duration which is required for the elevator car to stop at one landing floor, while a time duration required for the elevator car to run through the space between the succeeding floors is represented by set voltage VAD2. There are provided relay contacts $Ry2UA_1$ to $Ry9UA_1$ and $Ry2DA_1$ to $Ry10DA_1$ which are closed when the elevator car A is allotted with hall calls for the upward service at the second to ninth floors and the downward service at the second to tenth floors, respectively. These relay contacts are opened when the service has been completed. Contacts $2CA_1$ to $10CA_1$ are closed in response to the cage calls requesting the landing of the car A at the second to tenth floors, respectively. Reference symbols $AD2UA_1$ to $AD10DA_1$, $AD2UA_2$ to $AD10DA_2$ and AD1UA denote analogue adders, and symbols $F2UA_3$ to $F10DA_3$, $F2DA_4$ to $F10DA_4$ and $F1UA_3$ denote normally closed contacts of the position detecting relay which contacts are opened when the car A is positioned at the first to tenth floors in the upward and downward direction, respectively. A voltage signal AN1UA represents a period of time required for the elevator car A to reach the first floor.

Assuming now that the elevator car A is positioned at the fifth floor in the downward direction, wherein the contacts $F5DA_3$ and $F5DA_4$ are opened and a contact $DNA_1$ of a downward operation relay is closed, the set voltage VDA2 is applied to inputs of the adders $AD4DA_2$ to $AD2DA_2$ by transmission through the path formed by $AD5DA_2$, $F4DA_4$, $AD4DA_2$ and so forth and simultaneously applied directly to the other inputs of the adders $AD4DA_2$ to $AD2DA_2$. As a result, the adder $AD5DA_2$ will produce a voltage signal (VAD2) corresponding to the time required for the car to run through the distance between two adjacent floors, which distance will be also referred to as inter-floor distance. The adder $AD4DA_2$ is applied at the inputs thereof with the output voltage from the adder $AD5DA_2$ and the set voltage VAD2, thereby to produce a voltage signal (VAD2 × 2) corresponding to the time required for the car to run through two inter-floor distances. In similar ways, the adders $AD3DA_2$ and $AD2DA_2$ will produce voltage signals which represent the times corresponding to three and four inter-floor distances, respectively. The voltage signal representing the time required for the car A to run from the floor at which the car A is positioned to the first floor can thus be obtained from the output of the adder $AD2DA_2$ and transmitted to the adder AD1UA.

On the other hand, it is assumed that a cage call requesting the landing at the third floor is produced in the car A which is at the same time allotted with a hall call for the downward service at the fourth floor. In such situation, the contacts $3CA_1$ and $Ry4DA_1$ are closed. Consequently, the set voltage VAD1 is transmitted through the path formed by $Ry4DA_1$, $AD4DA_1$, $F3DA_3$ and $AD3DA_1$. The adder $AD4DA_1$ will then produce a voltage signal (VAD1) corresponding to a single stoppage of the car. Since the cage call contact $3CA_1$ is closed, the adder $AD3DA_1$ is applied at the inputs thereof with the output signal from the adder $AD4DA_1$ together with the set voltage VAD1 through the contacts $DNA_1$ and $3CA_1$. Thus, the adder $AD3DA_1$ will produce a voltage signal (VAD1 × 2) corresponding to two stoppages, which is transmitted sequentially through $AD3DA_1$, $F2DA_3$ and $AD2DA_1$. In this manner, the adder $AD2DA_1$ will produce the signal voltage (VAD1 × 2) representing the time required for the car A to stop twice before the arrival at the first floor. The output signal voltage from the adder $AD2DA_1$ is transmitted to the adder AD1UA.

As will be appreciated from the above description, the signal voltage representing the time required for the car to move from the positioned floor to the first floor and the signal voltage representing the time necessary for the twice stoppages in the descending course to the first floor are added together by the adder AD1UA. The output signal voltage AN1UA from the adder AD1UA obtained through the contact $F1UA_3$ will thus represent the total time required for the elevator car A to reach the first floor. For example, when the time required for the car to stop for the service to a call is in the order of 10 seconds while the time for running through an inter-floor distance is in the order of 2 seconds, the time predicting signal voltage AN1UA delivered from the adder AD1UA will represent 28 seconds by setting the voltages VAD1 and VAD2 correspondingly under the circumstances described above.

Although only the prediction signal AN1UA representing the time required for the arrival of the elevator car to be ascended at the first floor is obtained in the above embodiment, it is of course possible, for example, to predict the time required for the descending elevator car to reach the second floor simply by adding together the output signals from the adders $AD3DA_1$ and $AD3DA_2$.

Figure 12:
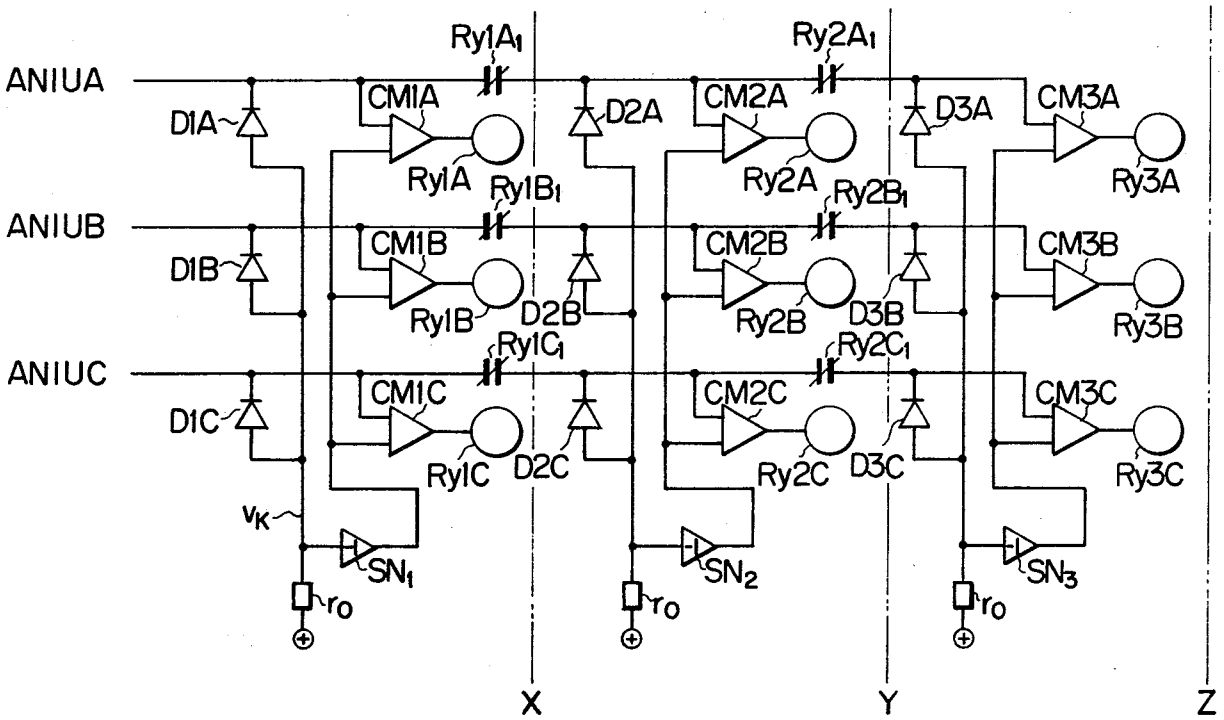
FIG. 12 is a schematic circuit diagram showing an arrival order estimating circuit used in association with the calculating circuit of FIG. 11.

FIG. 12 shows a circuit for estimating the arrival order on the basis of the prediction time calculated for each of the elevator cars by the time calculating circuit shown in FIG. 11.

It is assumed that the signal voltage representing the time for the car A to arrive at the first floor, that is, the signal AN1UA is 1V, while similar signal voltages for the cars B and C are 2V and 3V, respectively. Referring to FIG. 12, the first minimum value selecting circuit of a known type is constituted by diodes D1A to D1C, comparators CM1A to CM1C, a sign converters SN1 and a resistor $\gamma_0$. The second and third minimum value selecting circuits are similarly constituted by diodes D2A to D2C and D3A to D3C, comparators CM2A to CM2C and CM3A to CM3C, sign converters SN2 and SN3, and resistors $\gamma_0$, respectively. The lowest voltage of the signals AN1UA, AN1UB and AN1UC is selected by the first minimum value selecting circuit to drive the associated one of relays Ry1A to Ry1C. From the above assumption, the voltages of the signals AN1UA, AN1UB and AN1UC are 1, 2, and 3 volts, respectively, and thus a voltage $V_k$ at a junction point between the cathodes of the diodes D1A to D1C is equal to the minimum voltage of 1 volt minus a forward voltage drop across the diode. If the forward voltage drop is assumed to be zero for the sake of simplification, $V_k$ is equal to 1V, which is then converted into −1V by the sign converter SN1. The converted voltage is applied to the comparators CM1A to CM1C. The comparators CM1A to CM1C are fed with the voltage signals AN1UA to AN1UC, respectively, and accordingly the sums of two inputs at respective comparators CM1A, CM1B and CM1C will be oV (= 1V − 1V), 1V (= 1V − 11V) and 2V (= 3V − 1V), respectively. When the comparators CM1A to CM1C are so set that the output thereof be "1" when the input is smaller than or equal to zero, only the output from the comparator CM1A will become "1", thereby to energize the relay Ry1A, while the relays Ry1B and Ry1C remains deenergized. By the energization of the relay Ry1A, it is determined that the elevator car will first arrive at the first floor. When the relay Ry1A is energized, a normally closed contact $Ry1A_1$ of the relay Ry1A is opened, and thus the signal AN1UA is no more transmitted to the minimum value selecting circuit of the second stage. As a consequence, lower one of the signals AN1B and AN1C is selected at the second stage in the manner described above, whereby the relay Ry2B is energized to determined that the elevator car B will arrive second.

In a similar manner, the relay Ry3C is energized by the selecting circuit at the third stage to determine that the car C will arrive third. In FIG. 12, as will easily be understood, the circuit from the left hand side to a dot and dashed line X is used for estimating an elevator car arriving first, the circuit to a dot and dashed line Y is for estimating a car arriving second, and the circuit to a dot and dashed line Z is for estimating a car arriving third.

In the above embodiment, all the elevator cars A, B and C are subject to prediction and information of the arrival order. However, it will be appreciated that the number of the elevator cars of which arrival order is informed may be reduced, if desired, as described hereinbefore. For example, when prediction with respect to only two elevator cars of earlier arrival order is required, the circuit after the dot and dashed line Y in FIG. 12 must not be provided, so that the arrival order estimating circuit can be simplified. It is also effective to omit informing of the arrival order of a car which is predicted to take for its arrival a longer period of time than a predetermined period, since the running condition for such a car may be possibly changed in the meantime. This can be accomplished, for example, by comparing the signals AN1UA, AN1UB and AN1UC representative of the predicted time with a reference signal representative of the predetermined time to extract the predicted time representing signal smaller than the reference signal and applying the extracted signal to the circuit shown in FIG. 12.

In the embodiment described above, when the number of elevator cars the arrival order of which is to be informed is desired to be limited, it is effected by restricting the number of elevator cars which is to be predicted in their arrival order in the arrival order predicting device. However, it may be effected by restricting the number of elevator cars which is to be displayed or informed by the arrival order informing device. When the arrival order of elevator cars arriving first and second is displayed by using a display device such as shown in FIG. 3, for example, only the first and second arrival display sections are provided without the third and later arrival display sections. An embodiment of a driving circuit for such a display device is shown in FIG. 13.

Figure 13:
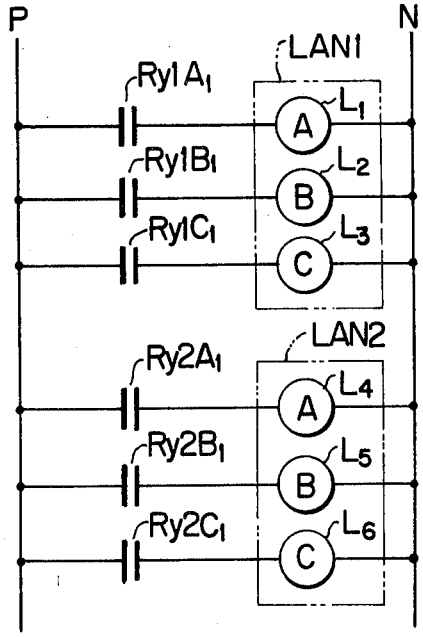
FIG. 13 is a schematic circuit diagram showing an example of a circuit connection of the display device of FIG. 3.

In FIG. 13, symbols $Ry1A_1$ to $Ry1C_1$ and $Ry2A_1$ to $Ry2C_1$ designate contacts of the relays Ry1A to Ry1C and Ry2A to Ry2C in the arrival order estimating circuit shown in FIG. 12. A display section LAN1 for displaying which car arrives first and a display section LAN2 for displaying which car arrives second have lamps $L_1$ to $L_3$ and $L_4$ to $L_6$, respectively, for making display for cars A, B, and C. In this arrangement, when the relay Ry1C (FIG. 12) is energized so that the car C is predicted to arrive first, the contact $Ry1C_1$ is closed. Thus, the lamp $L_3$ is illuminated to inform that the car C arrives first. Similarly, when the relay Ry2A is energized so that the car A is predicted to arrive second, the contact $Ry2A_1$ is closed. Thus, the lamp $L_4$ is illuminated to inform that the car A arrives second. It will easily be appreciated that provision of a similar display section for third arriving car permits display as shown in FIG. 3.

In the foregoing, the preferred embodiments of the invention have been shown and described. However, they are merely for the purpose of illustration and the invention is never restricted to these embodiments. The apparatus according to the invention is advantageously employed not only at the ground floor such as a lobby but also any other floors such as a mess hall where a crowd of passengers is foreseen. Although the invention has been described as realized by the analogue technic for the convenience' sake, it is of course possible to arrange the circuits so that the various signals can be digitally processed with correspondingly enhanced effect.

What we claimed is:

1. A service information apparatus for an elevator system including a plurality of elevator cars installed in juxtaposition for serving a plurality of floors and means for detecting positions of said cars, comprising means for predicting an order in which the elevator cars arrive at a predetermined floor from position signals delivered from said position detecting means, and means for giving information about the predicted arrival order of the elevator cars at the predetermined floor.

2. A service information apparatus as set forth in claim 1, wherein said arrival order predicting means is so arranged that the arrival order is predicted in accordance with the sequence of the positions of the elevators cars starting from an elevator car positioned nearest to the predetermined floor.

3. A service information apparatus as set forth in claim 2, wherein said arrival order predicting means is so arranged that the prediction of the arrival order is made only for elevator cars which are positioned within a predetermined range.

4. A service information apparatus as set forth in claim 1, wherein said arrival order predicting means comprises a calculating device provided for each of the elevator cars, having means for detecting landing floors at which the elevator car is to be stopped in response to call signals, for calculating a predicted period of time required for the elevator car to arrive at the predetermined floor, in response to the position signal and a landing floor detecting signal obtained from the landing floor detecting means, from the number of floors through which the elevator car is to pass and the number of the landing floors and for producing a signal proportional to the predicted period of time, and an estimating device for determining the arrival order of the elevator cars in accordance with the value of the signals produced from respective said calculating devices starting from the smallest signal.

5. A service information apparatus as set forth in claim 4, wherein said arrival order predicting means is so arranged that the arrival prediction is made for elevator cars of which the predicted period of time for arrival lies within a preset period of time.

6. A service information apparatus as set forth in claim 1, wherein the arrival order predicting means is so arranged that the prediction of the arrival order is made only for elevator cars which will arrive at the predetermined floor with predetermined earlier orders.

7. A service information apparatus as set forth in claim 1, wherein said information giving means is so constructed that the arrival information is given for elevator cars which will arrive at the predetermined floor with predetermined earlier orders.

8. A service information apparatus as set forth in claim 1, wherein said information giving means is provided for each of the elevator cars to give information of the arrival of the associated elevator car.

9. A service information apparatus as set forth in claim 1, wherein said information giving means is provided at an entrance of or in an elevator hall to generally indicate the arrival order of the elevator cars.

* * * * *